US006123402A

United States Patent [19]

Bowyer et al.

[11] Patent Number: 6,123,402

[45] **Date of Patent: *Sep. 26, 2000**

[54] CABINET HAVING A SUPPORT FOR A SLIDE MECHANISM

[75] Inventors: Steve Bowyer, Fruitport; Herman Smeetz, Holland; Alan Wright, Wyoming, all of Mich.

[73] Assignee: Herman Miller, Inc., Zeeland, Mich.

[ * ] Notice: This patent is subject to a terminal disclaimer.

[21] Appl. No.: 09/113,572

[22] Filed: Jul. 10, 1998

Related U.S. Application Data

[63] Continuation of application No. 08/667,437, Jun. 21, 1996, Pat. No. 5,785,401.

[51] Int. Cl.[7] ..... A47B 88/00

[52] U.S. Cl. ..... 312/334.7; 312/350; 108/110

[58] Field of Search ..... 312/350, 351, 312/257.1, 263, 334.4, 334.8, 334.32, 334.1, 330.1, 348.2, 334.7; 211/187, 191; 108/107, 110, 192, 193, 106

[56] References Cited

U.S. PATENT DOCUMENTS

| | | | |
|---|---|---|---|
| 1,164,439 | 12/1915 | Winquist . | |
| 1,513,429 | 10/1924 | Schmitz . | |
| 1,523,653 | 1/1925 | Larson et al. | 312/350 X |
| 1,934,644 | 11/1933 | Rand | 312/141 X |
| 1,937,935 | 12/1933 | Zimmerman | 211/136 |
| 1,976,810 | 10/1934 | Skar et al. | 211/136 |
| 2,088,315 | 7/1937 | Zalkind | 45/77 |
| 2,226,670 | 12/1940 | Pratt et al. | 312/141 |
| 2,547,463 | 4/1951 | Haut | 312/350 |
| 2,686,704 | 8/1954 | Wolters | 312/257 |
| 2,769,679 | 11/1956 | Wiseman | 312/350 |
| 2,815,649 | 12/1957 | Di Angelus et al. | 312/408 |
| 2,869,953 | 1/1959 | Miller et al. | 312/263 |
| 2,911,276 | 11/1959 | Hiers | 312/350 |
| 3,110,536 | 11/1963 | Costantini et al. | 312/350 |
| 3,168,365 | 2/1965 | Evans | 312/351 |
| 3,389,949 | 6/1968 | Studinski et al. | 312/339 |
| 3,572,874 | 3/1971 | Hassel | 312/350 |
| 3,862,691 | 1/1975 | Mori et al. | 211/176 |
| 4,073,556 | 2/1978 | Wilson, Jr. | 312/250 X |
| 4,201,428 | 5/1980 | Johnson | 312/257 |
| 4,681,381 | 7/1987 | Sevey | 312/333 X |
| 4,692,984 | 9/1987 | McKernan et al. | 29/445 |
| 5,269,602 | 12/1993 | Kuwahara et al. | 312/406 |
| 5,433,516 | 7/1995 | Beals et al. | 312/257.1 |
| 5,466,060 | 11/1995 | Hoffman | 312/334.8 |
| 5,470,143 | 11/1995 | Gill | 312/334.4 |
| 5,595,127 | 1/1997 | Eustace et al. | 108/109 X |
| 5,624,171 | 4/1997 | Soja et al. | 312/334.7 X |
| 5,632,542 | 5/1997 | Krivec | 312/334.7 |
| 5,775,786 | 7/1998 | Liebertz | 312/334.8 |

FOREIGN PATENT DOCUMENTS

| | | | |
|---|---|---|---|
| 3103281 | 8/1982 | Germany | 312/334.4 |

*Primary Examiner*—Peter M. Cuomo
*Assistant Examiner*—James O. Hansen
*Attorney, Agent, or Firm*—Brinks Hofer Gilson & Lione

[57] ABSTRACT

A vertical support for supporting a drawer slide mechanism in a cabinet. The vertical support includes a support member that has an opening and a resilient tab member that extends into the opening. The resilient tab member releasably engages the slide mechanism as it is disposed in the opening. Alternatively, a resilient tab member is attached to the slide mechanism and is adapted to releasably engage an opening in the front vertical support member.

26 Claims, 5 Drawing Sheets

CABINET HAVING A SUPPORT FOR A SLIDE MECHANISM

CROSS-REFERENCE TO RELATED APPLICATIONS

This application is a continuation of U.S. application Ser. No. 08/667,437 filed Jun. 21, 1996, now issued as U.S. Pat. No. 5,785,401, which application is hereby incorporated by reference herein.

BACKGROUND OF THE INVENTION

The present invention relates generally to a cabinet, such as a file cabinet, and more particularly, to an improved vertical support used to support drawers positioned in such a cabinet.

File cabinets of the type used in office environments are commonly configured with one or more drawers. Often, such drawers are supported by a pair of slide mechanisms that are attached to the side walls of the cabinet housing. Each slide mechanism typically is secured to a pair of vertical supports positioned along the side wall of the housing: one at the rear of the housing and another at the front of the housing. Often, in such an arrangement, the rear vertical support has a forwardly facing opening which is adapted to receive a rearwardly facing hook member disposed on a rear portion of the slide mechanism.

The front vertical support, typically configured as a channel, usually includes a surface that lies parallel to the housing side wall. Typically, this surface has a rectangular opening adapted to receive a portion of the slide mechanism. The slide mechanism typically has a forward hook member which engages the bottom edge of the opening and a lip portion that engages the top edge of the opening. When installed, the hook member and lip portion releasably secure the slide mechanism to the vertical support. Typically, the width and length of the opening are defined so that the slide mechanism is tightly secured to the support member.

To install the slide mechanism, the installer typically inserts the rear hook member into the forwardly facing opening in the rear vertical support. The forward hook member is then positioned on the bottom edge of the opening. The installer then applies a dynamic impact force to the slide mechanism to force the hook member down over the bottom edge of the opening and to force the lip portion past the top edge of the opening. Because the opening, hook members and lip portion are intended to provide a snug fit, the impact force required to install the slide mechanism can be quite significant.

SUMMARY OF THE INVENTION

Briefly stated, the invention is directed to an improved vertical support for supporting a slide mechanism in a cabinet. The vertical support includes a support member that has an opening adapted to receive the slide mechanism and a resilient tab member that is adapted to releasably engage the slide mechanism when disposed in the opening. In a preferred embodiment of the invention, the support member comprises a channel having a base section. The opening is positioned in the base section.

In one aspect of the invention, a cabinet having a housing and a drawer is provided. The vertical support is attached to the housing and a slide mechanism is attached to the vertical support. The drawer is supported on the slide mechanism.

In another aspect of the invention, an improved slide mechanism is provided to support the cabinet drawer. The slide mechanism has a forward and rear portion. The forward portion preferably includes two mounting members: a hook member, and a lip portion disposed on a side of the slide mechanism. When the slide mechanism is installed, the hook member is disposed on a bottom edge of the opening and the lip portion releasably engages the tab member extending downwardly from the base section.

In another aspect of the invention, a method is provided for assembling the support assembly which supports the sliding drawer in the cabinet. The method includes providing a housing, a slide mechanism that has a forward and rear portion, a rear vertical support member and a front vertical support member that has an opening and a resilient tab member extending into the opening. To assemble the support assembly, the vertical support members are attached to the housing. The rear portion of the slide mechanism is releasably secured to the rear vertical support member. The forward portion of the slide mechanism is releasably secured to the front vertical support member at the opening such that the tab member releasably engages the forward portion.

The present invention provides significant advantages over other vertical supports and methods for installing slide mechanisms on the vertical supports. Most importantly, when installing the slide mechanism, the resilient tab member deflects as the forward portion of the slide mechanism is inserted into the opening. Once the forward portion is inserted in the opening, the tab member snaps back to its original position thereby releasably securing the slide mechanism to the vertical support member. Because the tab member is resilient, less force is required to install the slide mechanism. Accordingly, the installer can easily apply the insertion force with his hand, rather than by using a mechanical aid such as a rubber mallet.

Another advantage of the invention is that the opening can be manufactured with less demanding tolerances while maintaining a secure attachment with the slide mechanism when installed. In particular, the distance between the free end of the tab member and the opposite side of the opening does not have to be maintained with tight tolerances because the tab member can deflect if the mounting members on the slide mechanism are slightly oversized.

The present invention, together with further objects and advantages, will be best understood by reference to the following detailed description taken in conjunction with the accompanying drawings.

DETAILED DESCRIPTION OF THE PREFERRED EMBODIMENTS

Figure 1:
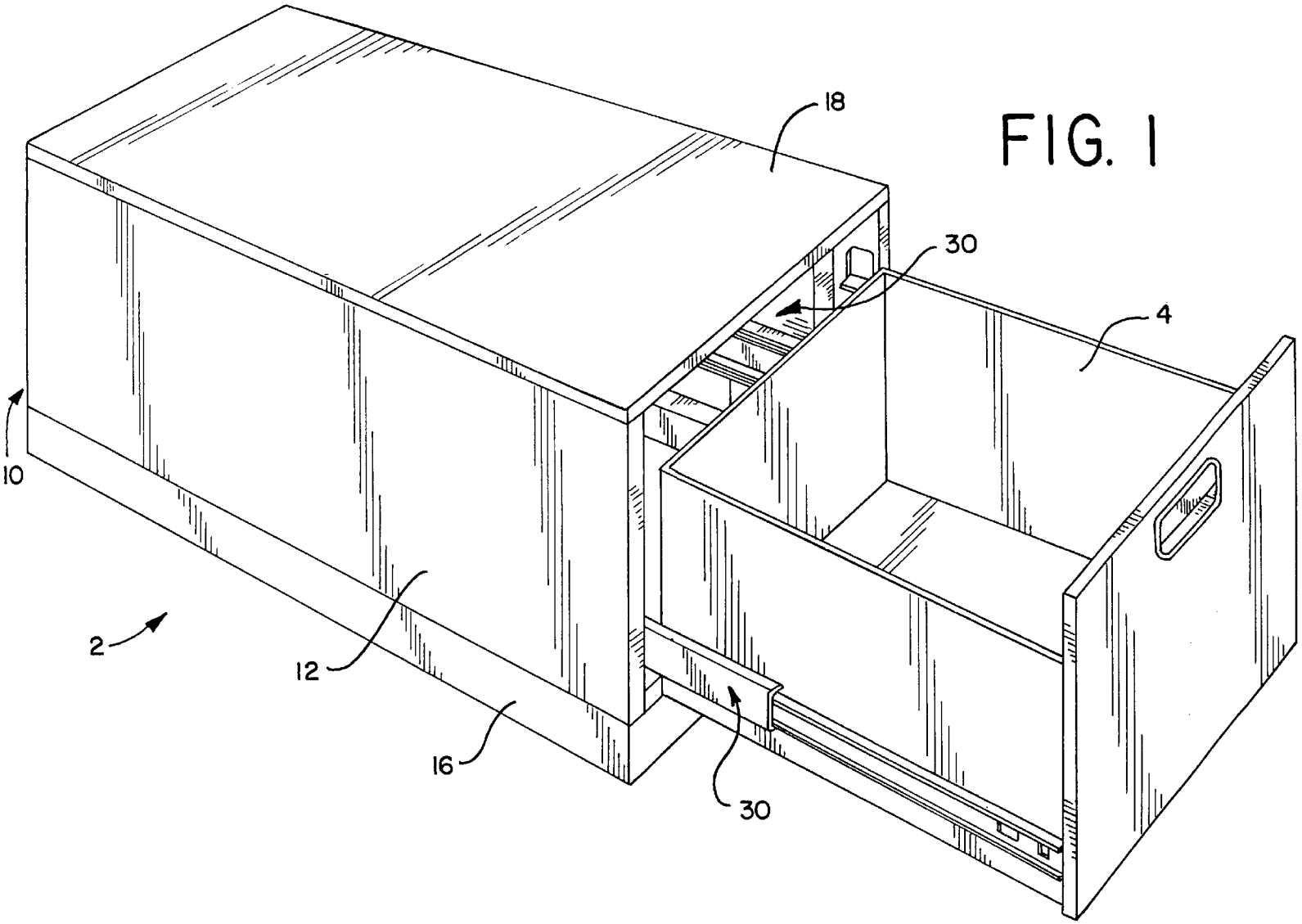
FIG. 1 is a perspective view of a file cabinet having a sliding drawer and a slide mechanism.
Figure 2:
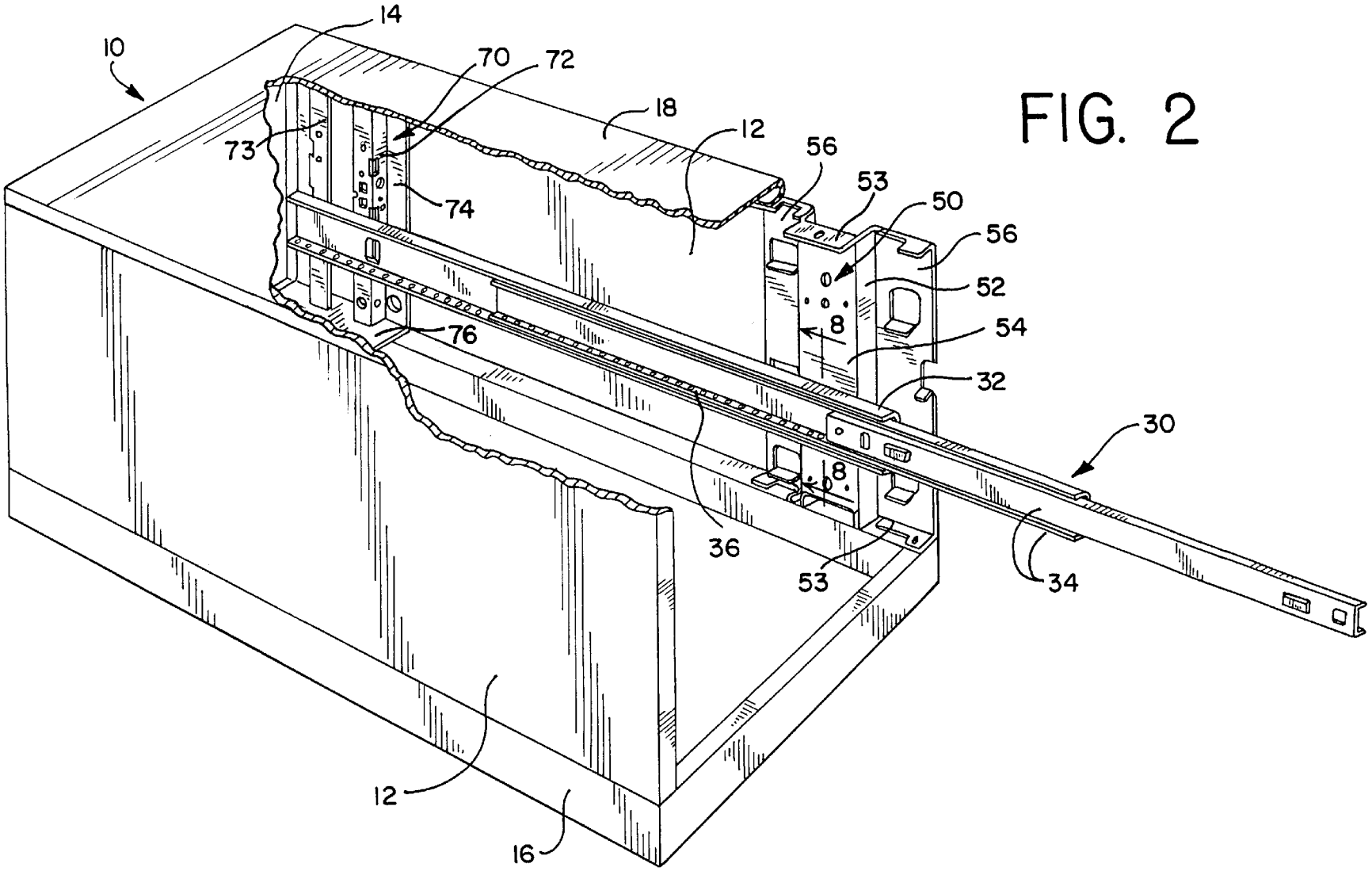
FIG. 2 is a perspective view of a file cabinet having a front and rear vertical support shown in cut away and a slide mechanism applied thereto.

Referring to the drawings, FIGS. 1 and 2 show a cabinet 2 having a housing 10, a sliding drawer 4, and a slide mechanism 30. The housing 10 includes a pair of side walls 12, a back wall 14, a base 16, and a top wall 18. A front vertical support 50 and a rear vertical support 70 are attached to each of the side walls 12. Preferably, the housing and vertical support members are made out of sheet metal.

Figure 10:
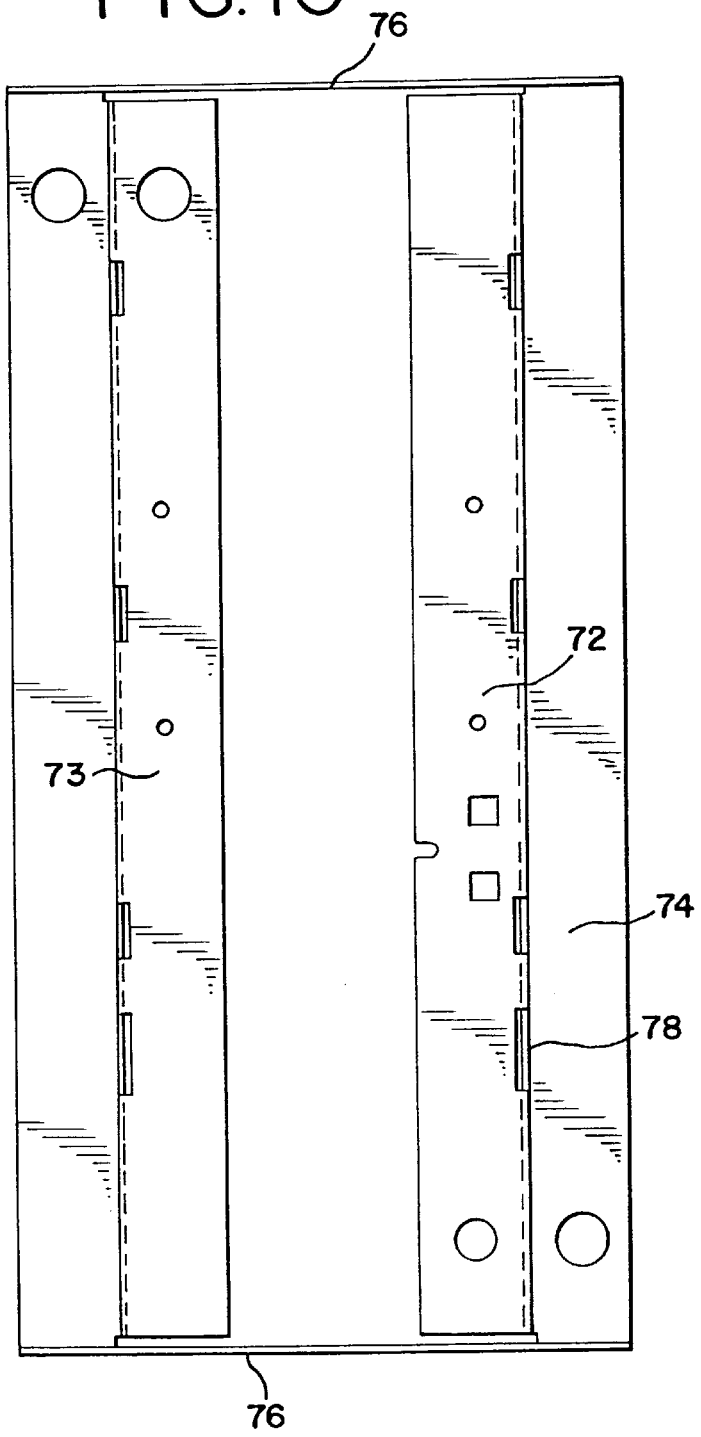
FIG. 10 is a side view of the rear vertical support.
Figure 11:
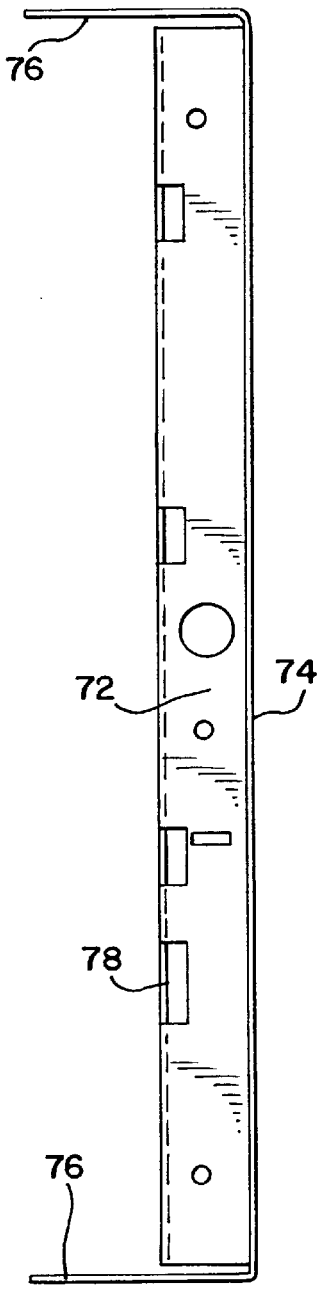
FIG. 11 is a front view of the rear vertical support.

Referring to FIGS. 10 and 11, the rear vertical support 70 is preferably configured as an open channel, having a pair of flanges 74 and a pair of L-shaped side legs 72 and 73. The front side leg 72 has an opening 78 positioned in it.

A top and bottom mounting flange 76 extend outwardly from the top and bottom of flanges 74 as shown in FIG. 11. The rear vertical support is fixedly attached to the housing by welding the mounting flanges to inwardly extending flanges on the top and bottom of the side wall 12, or, in the alternative, by employing a plurality of fasteners. The flanges 74 can also be welded directly to the sidewalls.

Figure 5:
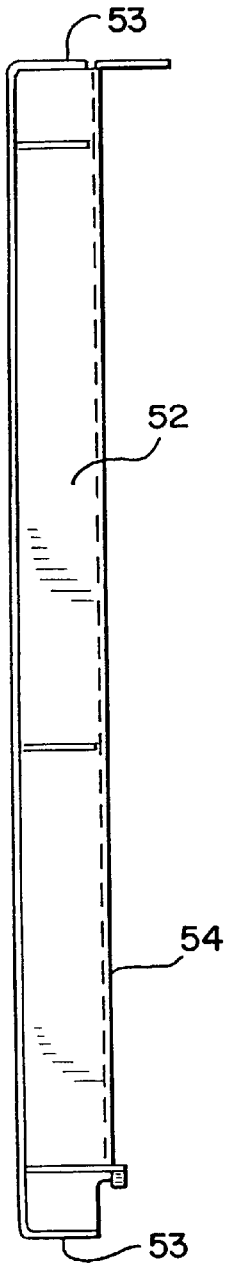
FIG. 5 is a rear view of a front vertical support.
Figure 3:
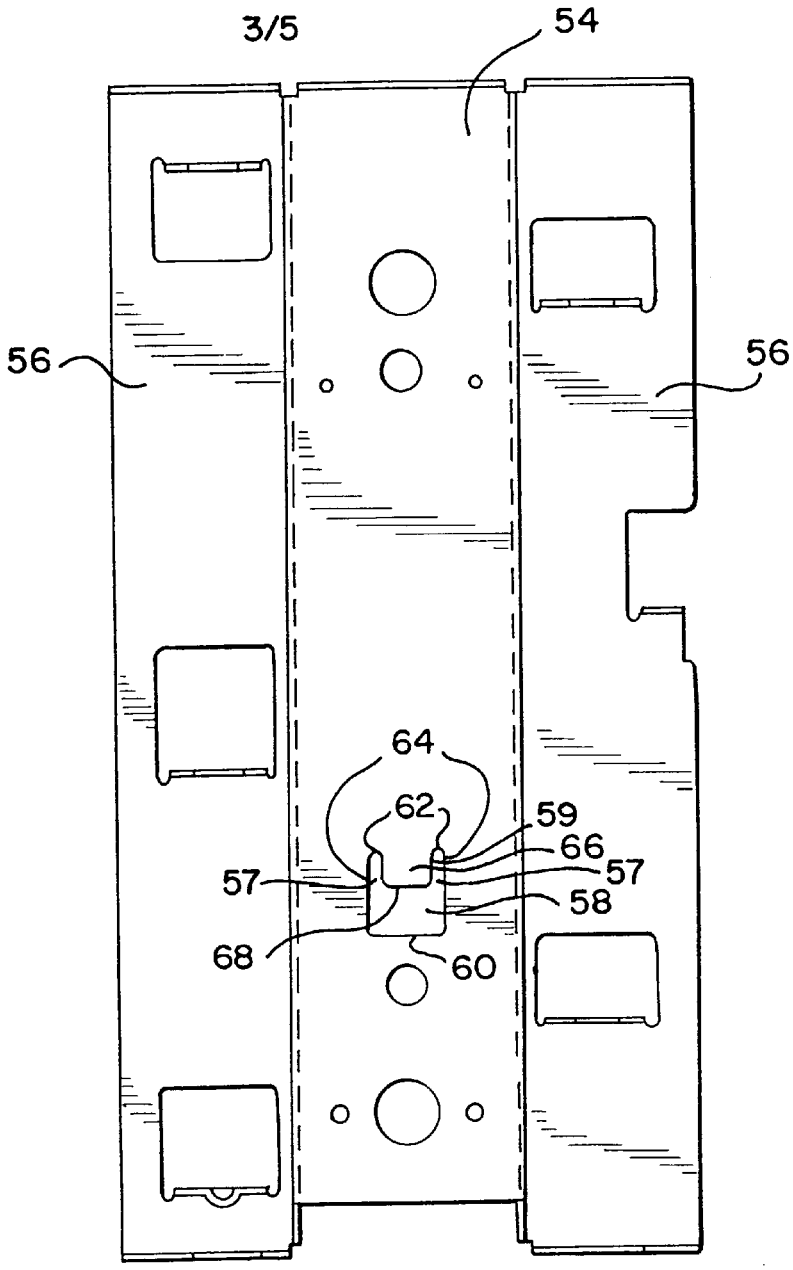
FIG. 3 is a side view of a front vertical support.
Figure 4:
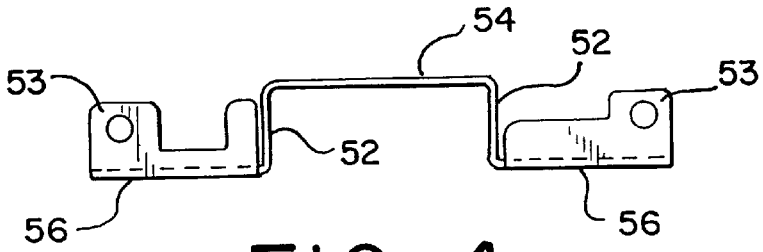
FIG. 4 is a bottom view of a front vertical support.
Figure 7:
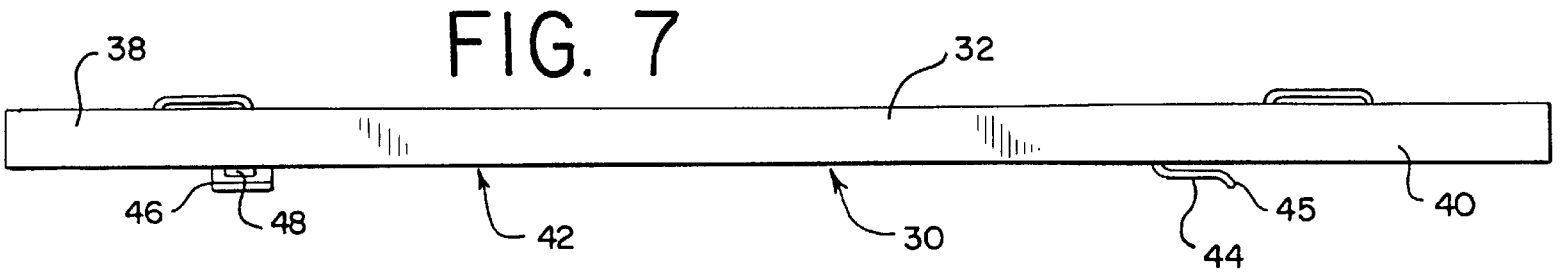
FIG. 7 is a top view of a slide mechanism.
Figure 6:
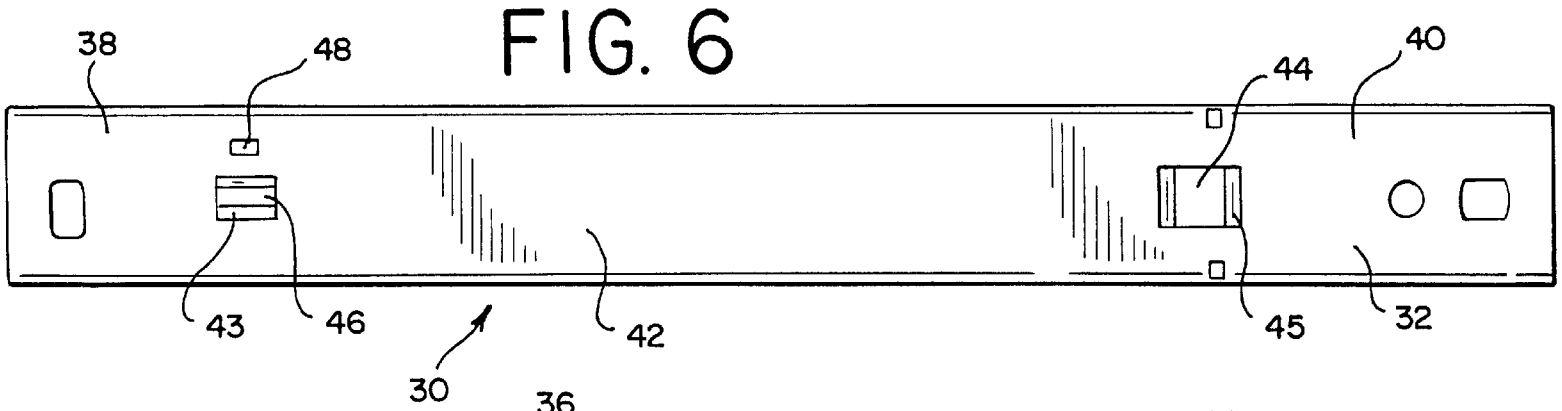
FIG. 6 is an side view of a slide mechanism.

The front vertical support member 50 is preferably configured as a channel with a pair of side legs 52, a base section 54 connecting the side legs, and a pair of flanges 56 extending perpendicularly from the side legs 52, as shown in FIGS. 3–5. The front vertical support 50 also includes mounting flanges 53 that extend outwardly from the top and bottom of the support. The base section 54 is spaced laterally inward from the side wall 12 of the housing. The front vertical support member is fixedly attached to the side wall 12 of the housing by welding or mechanically fastening the mounting flanges to top and bottom flanges on the sidewall, or by some comparable method.

Referring to FIG. 3, the base section 54 of the front vertical support member includes an opening 58 that is defined by a bottom edge 60, a top edge 62 and a pair of side edges 64. The dimensions of the opening 58 are dictated by the corresponding dimensions of the mating portion of the slide mechanism. For example, when using a slide mechanism, Model No. TR-200-US, produced by Thomas Regout USA, Inc., the opening preferably has a width of about 0.750 inches.

A resilient tab member 66 extends downwardly from the base section 54 of the front vertical support member into the opening 58. Preferably, the tab member 66 lies in the same plane formed by the base section, which is substantially flat as shown in FIG. 5. In a preferred embodiment, the tab member is about 0.375 inches long, although other lengths are acceptable. As shown in the FIG. 3, the distance between the bottom edge 60 of the opening and a free edge 68 of the tab member is preferably about 0.50 inches. As shown in FIG. 3, the tab member 66 preferably is formed by stamping two slots 57 in the base 54 that define the sides 59 of the tab member and form part of the opening 58.

Referring to FIGS. 2 and 6–8, the slide mechanism 30 includes a mounting bracket 32, two slide members 34, and a plurality of bearings 36 interfacing between the slide members 34 and the mounting bracket 32. An acceptable commercial slide mechanism is the Model TR-200-US mechanism sold by Thomas Regout USA, Inc. In operation, the slide members 34 extend outwardly from the mounting bracket 32 as the drawer 4, which is attached to the outermost slide member, is pulled outwardly from the housing 10. The mounting bracket 32 generally has a forward portion 38, a rear portion 40, a side surface 42 and a rear hook member 44 extending outwardly and rearwardly from the side surface at the rear portion 40. The rear hook member 44 is adapted to engage the opening 78 in the front side leg 72 of the rear vertical member.

Figure 8:
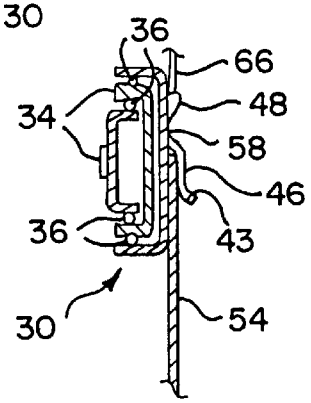
FIG. 8 is a cross section of a slide mechanism secured to a vertical support taken along line 8—8 of FIG. 2.

The forward portion 38 of the slide mechanism has a first and second mounting members 46, 48 that protrude from the side surface of the mounting bracket. The first mounting member 46 is preferably configured as a downwardly extending hook member, as shown in FIG. 8. The hook member 46 is spaced apart from the side surface 42 about 0.046 inches, which is about the thickness of the sheet metal forming the base section 54 of the front vertical support member. It should be understood that the space between the hook member 46 and side surface 42 can be altered to accommodate other thicknesses of sheet metal. The second mounting member 48 is preferably configured as a lip portion.

It should also be understood that other types of mounting members, such as a single boss protruding from the slide mechanism, would also interface with the improved vertical support member described herein.

To install the slide mechanism 30, as shown in FIG. 2, an installer first inserts the rearwardly extending rear hook member 44 into the opening 78 in the rear vertical support member, so that the first and second mounting members 46, 48 are aligned with the opening 58 in the front vertical support member. Preferably, the rear hook member 44 includes an end portion 45 that is angled away from the side surface 42 so as to ease the insertion of the hook member 44 into the opening 78. Similarly, the forward hook member 46 also preferably has an end portion 43 that is angled away from the side surface 42.

The installer slides the end portion 43 of the forward hook member 46 onto the bottom edge 60 of the opening. The installer then applies a downward and lateral force to the slide mechanism 30, forcing the forward hook member 46 over the bottom edge of the opening while simultaneously forcing the lip portion 48 past the free edge 68 of the tab member 66 as shown in FIG. 8. Because the tab member 66 is resilient, it deflects during the insertion of the lip portion 48 and springs back to its original position once the lip portion 48 clears the free edge 68. Because the tab member 66 deflects, less energy is required to install the slide mechanism.

Previously, the installer was required to force the lip portion past a rigid top edge that defined the opening in the base section. Because the top edge does not deflect, a greater force is required to install the slide mechanism, thereby making installation more difficult for the installer.

The improved vertical support also facilitates the removal of a worn or damaged slide mechanism. In essence, the reverse procedure is followed; the installer forces the lip portion away from the free edge of the tab member causing it to deflect. Once the lip portion disengages from the free edge, the resilient tab member snaps back to its original configuration. Thus, the force required to remove the slide mechanism is reduced as when compared to the prior art structure.

Figure 9:
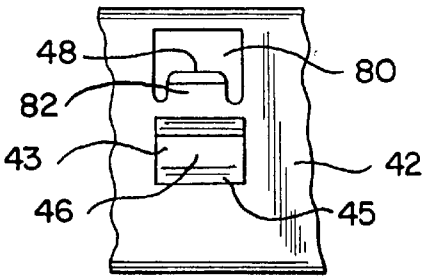
FIG. 9 is a partial side view of an alternative slide mechanism with a resilient tab member.

As an alternative to the aforedescribed improvement to the vertical support member, the slide mechanism can also be altered to reduce the installation force. In such an embodiment the vertical support member has a rectangular opening, but does not have a resilient tab member extending into the opening. Instead, as shown in FIG. 9, an opening 80 is formed in the side surface 42 of the slide mechanism around three sides of the lip portion 48. In this way, the lip portion becomes a resilient tab member 82. Accordingly, when installing the slide mechanism, the resilient tab member 82, i.e., the lip portion having a relief cut around it, deflects as it is forced past the rigid top edge defining the opening in the vertical support member. Once the lip portion passes the top edge, the resilient tab member 82 returns to its original position, thereby releasably securing the slide mechanism to the vertical support member with a minimum of installation force.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

We claim:

1. A cabinet comprising:

a housing having a side wall;

a support member disposed on said side wall of said housing, said support member having an opening defined by a bottom edge in said support member, said support member comprising a tab member extending downwardly into said opening toward said bottom edge, said tab member terminating in a free edge spaced apart from and facing said bottom edge of said opening in said support member;

a drawer comprising a side portion;

a slide mechanism comprising a mounting bracket and at least one slide member slidably connected to said mounting bracket, said mounting bracket engaging said support member at said bottom edge of said opening and at said free edge of said tab member so as to be mounted to said support member, said mounting bracket extending horizontally along said side wall of said housing, and wherein said at least one of said slide members is attached to said drawer along said side portion thereof such that said drawer and said at least one slide member can be pulled outwardly from said mounting bracket and said housing.

2. The cabinet of claim 1 wherein said mounting bracket comprises a first mounting member engaging said support member at said bottom edge formed by said opening and a second mounting member engaging said free edge of said resilient tab member.

3. The cabinet of claim 2 wherein said first mounting member comprises a hook member.

4. The cabinet of claim 3 wherein said hook member is spaced apart from a side surface of said mounting bracket.

5. The cabinet of claim 2 wherein said second mounting member comprises a lip portion.

6. The cabinet of claim 1 wherein said support member extends vertically along the side wall of the housing.

7. The cabinet of claim 6 wherein said side wall comprises a forward portion, and wherein said support member is attached to said forward portion of said side wall.

8. The cabinet of claim 1 wherein said at least one slide member comprises a first and second slide member, said first slide member slidably connected to said mounting bracket and said second slide member slidably connected to said first slide member, said second slide member attached to said drawer along said side portion thereof.

9. A cabinet comprising:

a drawer slidably supported in said cabinet;

a support member having an opening defined by an edge in said support member and comprising a tab member extending into said opening toward said edge, said tab member terminating in a free edge spaced apart from and facing said edge of said opening; and a slide mechanism comprising a mounting bracket and at least one slide member slidably connected to said mounting bracket, said mounting bracket comprising a first and second mounting member, said first mounting member engaging said support member at said edge of said opening, said second mounting member engaging said tab member, said at least one slide member attached to said drawer, wherein said at least one slide member is moveable between a retracted position where the drawer is positioned in said cabinet and an extended position where the drawer is accessible to the user.

10. The cabinet of claim 9 wherein said edge comprises a bottom edge of said opening in said support member, and wherein said tab member extends downwardly from said support member towards said bottom edge.

11. The cabinet of claim 9 wherein said first mounting member comprises a hook member.

12. The cabinet of claim 11 wherein said hook member is spaced apart from a side surface of said mounting bracket.

13. The cabinet of claim 9 wherein said second mounting member comprises a lip portion.

14. The cabinet of claim 9 wherein said cabinet further comprises a housing having a side wall, and wherein said support member extends vertically along the side wall of the housing.

15. The cabinet of claim 14 wherein said side wall comprises a forward portion, and wherein said support member is attached to said forward portion of said side wall.

16. The cabinet of claim 9 wherein said support member comprises a base section defining a plane, said opening formed in said base section, and wherein said tab member remains substantially in the same plane defining said base section upon engagement with said second mounting member of said mounting bracket.

17. The cabinet of claim 9 wherein said at least one slide member comprises a first and second slide member, said first slide member slidably connected to said mounting bracket and said second slide member slidably connected to said first slide member, said second slide member attached to said drawer.

18. A cabinet comprising:

a support member having an opening defined by a bottom edge in said support member and comprising a tab member extending downwardly into said opening toward said bottom edge, said tab member terminating in a free edge spaced apart from and facing said edge of said opening; and a slide mechanism comprising a mounting bracket and at least one slide member slidably connected to said mounting bracket, said mounting bracket comprising a means for engaging said bottom edge of said opening in said support member and a means for engaging said free edge of said tab member, said at least one slide member adapted to support a drawer in said cabinet.

19. The cabinet of claim 18 wherein said means for engaging said bottom edge comprises a hook member.

20. The cabinet of claim 19 wherein said hook member is spaced apart from a side surface of said mounting bracket.

21. The cabinet of claim 20 wherein said support member further comprises a side surface, and where said hook member includes an end portion angled away from said side surface.

22. The cabinet of claim 18 wherein said means for engaging said free edge comprises a lip portion.

23. A cabinet comprising:

a housing having a side wall;

a support member disposed on said side wall of said housing, said support member having an opening defined by an edge in said support member, said support member comprising a tab member extending into said opening toward said edge, said tab member terminating in a free edge spaced apart from and facing said edge of said opening in said support member;

a drawer comprising a side portion;

a slide mechanism comprising a mounting bracket and at least one slide member slidably connected to said mounting bracket, wherein said mounting bracket comprises a first mounting member engaging said free edge of said resilient tab member, said mounting bracket extending horizontally along said side wall of said housing, and wherein said at least one of said slide members is attached to said drawer along said side portion thereof such that said drawer and said at least one slide member can be pulled outwardly from said mounting bracket and said housing.

24. The cabinet of claim 23 wherein said first mounting member comprises a hook member.

25. The cabinet of claim 24 wherein said hook member is spaced apart from a side surface of said mounting bracket.

26. The cabinet of claim 23 wherein said second mounting member comprises a lip portion.

* * * * *